United States Patent [19]

Rupprecht

[11] Patent Number: 4,652,142

[45] Date of Patent: Mar. 24, 1987

[54] WATCH DRIVE

[75] Inventor: Gerhard Rupprecht, Eisingen, Fed. Rep. of Germany

[73] Assignee: Pforzheimer Uhren-Rohwerke Porta GmbH, Pforzheim, Fed. Rep. of Germany

[21] Appl. No.: 849,720

[22] Filed: Apr. 9, 1986

[30] Foreign Application Priority Data

Apr. 9, 1985 [DE] Fed. Rep. of Germany ..... 3512701

[51] Int. Cl.[4] ..... G04B 29/00

[52] U.S. Cl. ..... 368/324

[58] Field of Search ..... 368/76, 80, 88, 220, 368/322–326; 384/226, 227, 295, 296; 29/177, 178; 74/63

[56] References Cited

FOREIGN PATENT DOCUMENTS 2620735 11/1976 Fed. Rep. of Germany .
355090 7/1961 Switzerland .
376061 8/1964 Switzerland .

*Primary Examiner*—Vit W. Miska

[57] ABSTRACT

A watch drive has an electric stepping motor and other drive elements supported between opposite drive plates. A tubular center bearing is mounted on one of the drive plates and carries a watch hand shaft to which motion is transmitted from the stepping motor by way of an intermediate gear which is mounted on an intermediate gear shaft supported in a bearing projection extending from a mounting collar of the tubular center bearing. The bearing projection is disposed adjacent a cut-out area of the drive plate which cut-out area is sufficiently large to permit insertion of the small drive elements between the drive plates during assembly of the watch drive and to provide for the small size of the watch drive.

3 Claims, 4 Drawing Figures

WATCH DRIVE

BACKGROUND OF THE INVENTION

The invention relates to a watch drive of an electric watch including a stepping motor having an intermediate gear disposed between the drive's electric stepping motor and a hand gear supported in a tubular center bearing which is provided with a collar abutting one of the drive's opposite bearing support plates.

As shown in DE OS No. 2620735 a support bearing for the shaft of the intermediate gear of an electric watch drive arrangement is always disposed on one of a watch drive's opposite bearing support plates next to the tubular center bearing structure which supports the watch's hands. In the process of miniaturization of watches not only the diameter of watch drives and the diameter of the gears within but also the thickness of the drives have been reduced. In modern miniaturized watches the gears have already become so small in diameter that there is hardly sufficient space and material left on the drive plate next to the center bearing structure to support the intermediate gear bearing. Also there is a need for space in this area which is utilized by modern watches to accommodate certain necessary elements (hour and minute hand drives) which are disposed on the front side of the watch drive.

The present invention provides for an arrangement which permits proper support of all the necessary bearings, especially of the intermediate gear for which particularly little space is left next to the tubular center shaft bearing.

SUMMARY OF THE INVENTION

This is achieved by a watch drive wherein a stepping motor and gears are supported between adjacent drive plates and a tubular center bearing structure is mounted on one of the plates and carries a watch hand shaft to which motion is transmitted from the stepping motor by way of an intermediate bearing mounted on an intermediate bearing shaft rotatably supported by a bearing projection extending from the mounting collar of the center bearing structure. Adjacent the bearing projection the drive plate has a cut-out area which is sufficiently large to permit insertion of the small drive elements between the drive plates during assembly of the watch drive. The arrangement also permits use of miniaturized elements and narrowing the space between the drive plates thereby permitting a reduction in size of the watch drive.

It is noted that with this arrangement the intermediate gear shaft bearing is not directly supported by the drive plates but rather the collar of the tubular central bearing support which abuts the drive plate. The drive plate is provided with a cut-out adapted to accommodate the bearing structure for the intermediate gear such that the width of the drive may be reduced by the thickness of a drive plate. Also, the cut-out may be utilized to facilitate assembly of parts between the drive plates. Furthermore the distance of the intermediate gear bearing axis from the central bearing axis is firmly given by the arrangement. Smaller gears can be utilized in the drive as they can be easier assembled under tight space conditions.

Preferably, the tubular bearing support's collar has a radial indexing projection angularly spaced from the bearing support projection which also fits into a corresponding cut-out in the respective drive plate for firmly locating the collar. However, in place of such an indexing projection the collar may be provided with a cavity adapted to receive a corresponding indexing projection of the respective drive plate.

SHORT DESCRIPTION OF THE DRAWINGS

DESCRIPTION OF A PREFERRED EMBODIMENT

Figure 1:
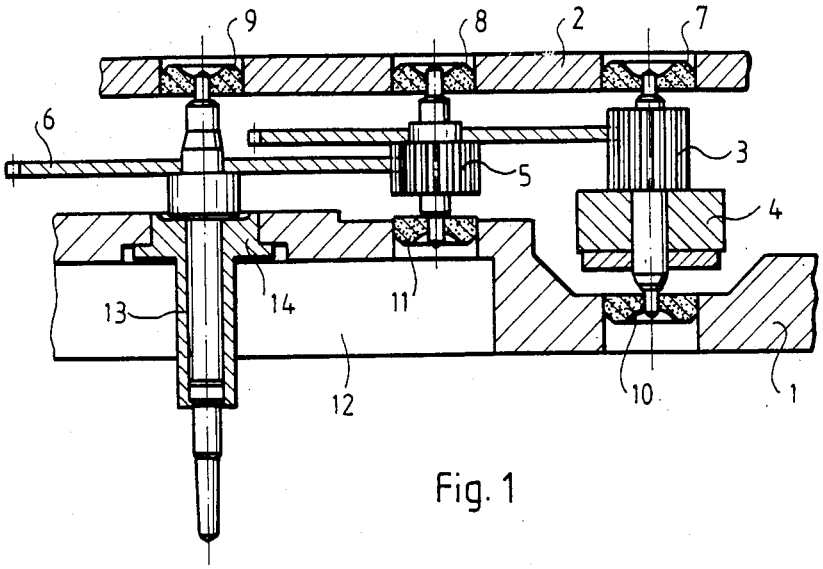
FIG. 1 shows a watch drive as presently in use.
Figure 2:
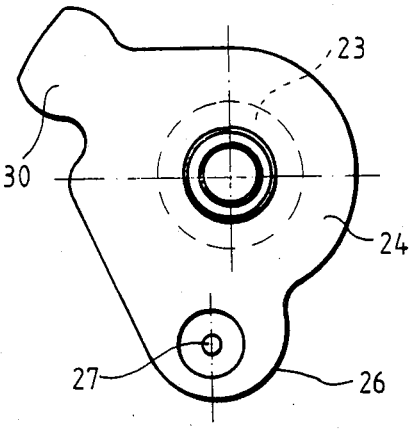
FIG. 2 is an axial view of the central tubular bearing support and the collar associated therewith.
Figure 3:
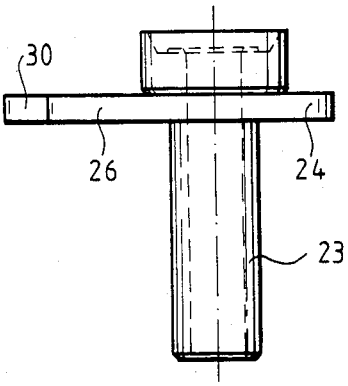
FIG. 3 is a side view of the central tubular bearing support of FIG. 2.

As shown in FIG. 1, prior art watch drives have opposite drive plates 1 and 2 which support therebetween a rotor 4 of a stepping motor with a gear portion 3, an intermediate gear 5 and the second hand gear 4. The drive plate 2 is flat so that the bearings 7, 8 and 9 for the shafts of gears 3, 5 and 6 are disposed in a single plane, that is, the plane of plate 2. The opposite bearing 10 of the rotor 4 is mounted in a recessed area of the drive plate 1. The bearing 11 of the intermediate gear 5 is arranged in an inwardly projecting area of the plate 1 such that there is provided a cavity 12 in the drive plate 1 which, though of only relatively little depth, is adapted to receive certain design elements at the face side of the watch. The drive plate 1 also carries the central tubular bearing support structure 13 which is provided with a collar 14 received in a corresponding cavity formed into the drive plate 1. The collar abuts the drive plate 1 and is firmly fixed thereto, for example by riveting.

In this prior art arrangement the shaft bearing for the intermediate gear 5 is mounted directly on the drive plate 1 of the watch drive.

Figure 4:
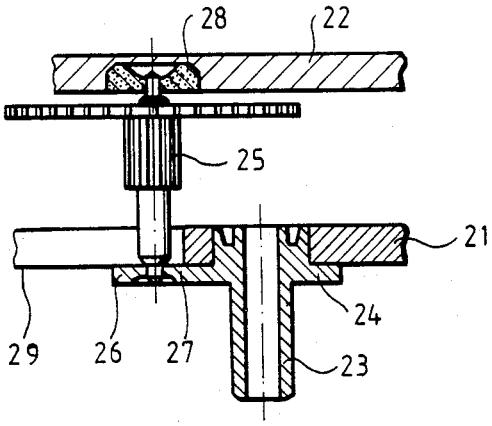
FIG. 4 shows a portion of watch drive like the one of FIG. 1, however with a central tubular bearing support and its collar having the intermediate gear supported thereon.

In order to provide for sufficient clearance for the construction elements and also to provide for a reduction in the drive's thickness and, furthermore, in order to permit closer spacing between the intermediate gear bearing and the center bearing tube, the present invention provides for an arrangement in accordance with FIG. 4, which also has two spaced drive plates 21, 22 for supporting the watch drive's bearings. The intermediate gear 25 is reduced in size as compared to the gear 5 of FIG. 1 and its shaft is supported at one end in bearing 28 mounted in drive plate 22. At its opposite end the intermediate gear shaft is not directly supported by the drive plate 21 but in a radial bearing projection 26 of the collar 24 of the tubular center bearing structure 23 which is also reduced in size. The bearing portion 27 is disposed adjacent the outer surface of the drive plate 21 so that the distance between the drive plates 21 and 22 is also reduced. There is also provided an open space 29 in the drive plate 21 which facilitates introduciton of drive elements into the space between the drive plates during assembly of the watch drive.

Displaced angularly by an angle of about 120° with respect to the bearing portion 27 the collar 24 has an indexing projection 30 adapted to engage the drive plate for proper positioning of the collar 24 with regard to the drive plate 1.

I claim:

1. A watch drive comprising opposite drive plates having supported therebetween an electric stepping motor, a tubular center bearing structure mounted on one of said plates for rotatably supporting the watch's hand, said center bearing structure having a collar, said drive plate having a cut-out area adjacent said center bearing structure sufficiently large to permit passage therethrough of drive elements so as to facilitate assembly of the watch drive, said collar having a radial bearing support projection extending over said cut-out area and providing a bearing support and an intermediate gear structure having a shaft supported by said bearing support projection and an intermediate gear in engagement with a gear structure on a shaft supported by said center bearing structure.

2. A watch drive according to claim 1, wherein said collar has angularly spaced from said bearing support projection an indexing projection adapted to engage said drive plate in a predetermined position so as to angularly locate said collar.

3. A watch drive according to claim 1, wherein said collar has a projection adapted to be received in a cavity in said drive plate for angularly locating said collar.

* * * * *